US012006931B2

(12) United States Patent
Shampine et al.

(10) Patent No.: US 12,006,931 B2
(45) Date of Patent: Jun. 11, 2024

(54) CROSSHEAD BUSHING SYSTEMS AND METHODS

(71) Applicant: SCHLUMBERGER TECHNOLOGY CORPORATION, Sugar Land, TX (US)

(72) Inventors: Rod Shampine, Houston, TX (US); Hau Nguyen-Phuc Pham, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 49 days.

(21) Appl. No.: 18/000,991

(22) PCT Filed: Jun. 15, 2021

(86) PCT No.: PCT/US2021/037439
§ 371 (c)(1),
(2) Date: Dec. 7, 2022

(87) PCT Pub. No.: WO2021/257570
PCT Pub. Date: Dec. 23, 2021

(65) Prior Publication Data

US 2023/0213032 A1 Jul. 6, 2023

Related U.S. Application Data

(60) Provisional application No. 63/038,975, filed on Jun. 15, 2020.

(51) Int. Cl.
*F04B 53/14* (2006.01)
*F04B 39/00* (2006.01)
(Continued)

(52) U.S. Cl.
CPC ..... *F04B 53/147* (2013.01); *F04B 39/0094* (2013.01); *F04B 39/121* (2013.01);
(Continued)

(58) Field of Classification Search
CPC .. F04B 53/147; F04B 39/0094; F04B 39/121; F04B 39/128; F04B 39/14; F04B 53/006;
(Continued)

(56) References Cited

U.S. PATENT DOCUMENTS

2016/0025090 A1* 1/2016 Bayyouk ..... F04B 53/16 92/161
2017/0370524 A1* 12/2017 Wagner ..... F04B 23/02
(Continued)

FOREIGN PATENT DOCUMENTS

KR 10-2017-0036083 3/2017

OTHER PUBLICATIONS

Search Report and Written Opinion of International Patent Application No. PCT/US2021/037439 on Oct. 1, 2021; 13 pages.
(Continued)

*Primary Examiner* — Bryan M Lettman
(74) *Attorney, Agent, or Firm* — Jeffrey D. Frantz

(57) ABSTRACT

A reciprocating pump includes a fluid section that includes fluid-displacing members and a power section that includes crossheads coupled to a respective fluid-displacing member. The power section actuates the fluid section by actuating the crossheads through respective crosshead bores formed through the power section. The power section also includes structural members, pairs of support plates, and pairs of arcuate crosshead sections secured in place between the structural members against a respective pair of support plates. Each pair of the arcuate guide sections comprises a top section and a bottom section that form a portion of a respective crosshead bore. Each pair of the arcuate crosshead guide sections are also secured in place using clamping segments secured to edges of windows of the structural members by bolts extending through interior passages of the
(Continued)

clamping segments and having threads that mate with threaded holes extending into the edges of the windows.

18 Claims, 14 Drawing Sheets

(51) Int. Cl.
*F04B 39/12* (2006.01)
*F04B 39/14* (2006.01)
*F04B 53/00* (2006.01)

(52) U.S. Cl.
CPC ..... *F04B 39/128* (2013.01); *F04B 39/14* (2013.01); *F04B 53/006* (2013.01)

(58) Field of Classification Search
CPC ..... F04B 39/12; F04B 53/16; B23C 2220/52; B23C 2220/24; B23C 2220/00; B23C 2220/48; B23C 2220/28; B23C 2215/242; Y10T 29/49236; Y10T 29/49947; Y10T 29/49968
See application file for complete search history.

(56) References Cited

U.S. PATENT DOCUMENTS

| | | | | |
|---|---|---|---|---|
| 2018/0030973 | A1 | 2/2018 | Bayyouk | |
| 2018/0135617 | A1* | 5/2018 | Ma | F04B 19/22 |
| 2018/0266413 | A1* | 9/2018 | Kerr | F04B 1/0421 |
| 2019/0136840 | A1 | 5/2019 | Kumar et al. | |
| 2020/0141401 | A1* | 5/2020 | Kumar | B21K 23/00 |
| 2022/0106951 | A1* | 4/2022 | Foster | F04B 1/0476 |

OTHER PUBLICATIONS

International Preliminary Report on Patentability of International Patent Application No. PCT/US2021/037439 dated Dec. 29, 2022, 7 pages.

* cited by examiner

CROSSHEAD BUSHING SYSTEMS AND METHODS

CROSS-REFERENCE TO RELATED APPLICATION

The present document is a National Stage Entry of International Application No. PCT/US2021/037439, filed Jun. 15, 2021, which is based on and claims priority to U.S. Provisional Application Ser. No. 63/038,975, filed Jun. 15, 2020, which is incorporated herein by reference in its entirety.

BACKGROUND

The present disclosure generally relates to systems and methods for manufacturing reciprocating pumps.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

High-volume, high-pressure pumps are utilized at wellsites for a variety of pumping operations. Such operations may include drilling, cementing, acidizing, water jet cutting, hydraulic fracturing, and other wellsite operations. For example, one or more positive displacement reciprocating pumps may be utilized to pressurize low-pressure fluid from one or more mixers, blenders, and/or other fluid sources for injection into a well.

Each reciprocating pump may include a plurality of reciprocating, fluid-displacing members (e.g., pistons, plungers, diaphragms, etc.) driven by a crankshaft into and out of a fluid-pressurizing chamber to alternatingly draw in, pressurize, and expel fluid from the fluid-pressurizing chamber. Each reciprocating member discharges the fluid from its fluid-pressurizing chamber in an oscillating manner, resulting in suction and discharge valves of the pump alternatingly opening and closing during pumping operations.

Success of pumping operations at a wellsite may be affected by many factors, including efficiency, failure rates, and safety related to operation of the reciprocating pumps. Vibration and repetitive high forces and pressures generated by the reciprocating pumps may cause mechanical fatigue, wear, and/or other damage to the pumps, which may decrease pumping flow rates, quality of downhole operations, and/or operational efficiency.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a reciprocating pump. The reciprocating pump includes a fluid section including a plurality of fluid-displacing members. Each fluid-displacing member is configured to displace fluid through the reciprocating pump. The reciprocating pump also includes a power section including a plurality of crossheads. Each crosshead is coupled to a respective fluid-displacing member. The power section is configured to actuate the fluid section by actuating the plurality of crossheads through respective crosshead bores formed through the power section. The power section includes a plurality of structural members. The power section also includes a plurality of pairs of support plates. Each pair of support plates is permanently joined to two structural members of the plurality of structural members. Each support plate comprises a precision interior surface. The power section further includes a plurality of pairs of arcuate crosshead guide sections. Each arcuate crosshead guide section is secured in place between two structural members of the plurality of structural members against a respective pair of support plates of the plurality of pairs of support plates. Each pair of arcuate crosshead guide sections includes a top arcuate crosshead guide section and a bottom arcuate crosshead guide section configured to form a portion of a respective crosshead bore.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
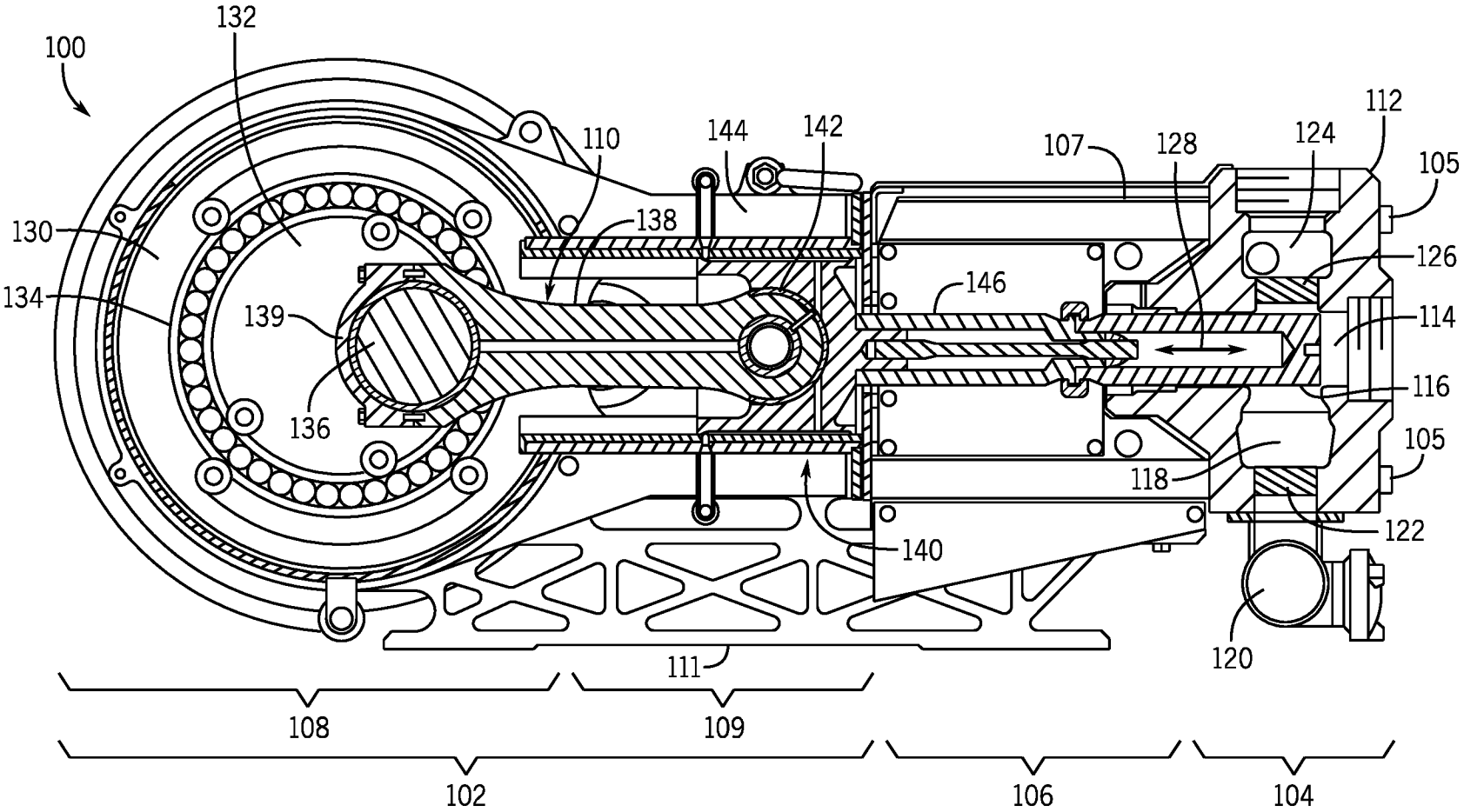
FIG. 1 is a sectional side view of at least a portion of a positive displacement reciprocating pump, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed or otherwise related to structure and operation of a positive displacement reciprocating pump. The pump may be utilized or otherwise implemented for pumping a fluid at an oil and gas wellsite, such as for pumping a fluid into a well. For example, a pump according to one or more aspects of the present disclosure may be utilized or otherwise implemented in association with a well construction system (e.g., a drilling rig) to pump a drilling fluid through a drill string during well drilling operations. A pump according to one or more aspects of the present disclosure may also or instead be utilized or otherwise implemented in association with a well fracturing system to pump a fracturing fluid into a well during well fracturing operations. A pump according to one or more aspects of the present disclosure may also or instead be utilized or otherwise implemented in association with a well cementing system to pump a cement slurry into a well during casing cementing operations. However, a pump according to one or more aspects of the present disclosure may also or instead be utilized or otherwise implemented for performing other pumping operations at an oil and gas wellsite and/or other worksites. For example, a pump according to one or more aspects of the present disclosure may be utilized or otherwise implemented for performing acidizing, chemical injecting, and/or water jet cutting operations. Furthermore, a pump according to one or more aspects of the present disclosure may be utilized or otherwise implemented at mining sites, building construction sites, and/or other work sites at which fluids are pumped at high volumetric rates and/or pressures.

FIG. 1 is a sectional side view of at least a portion of a positive displacement reciprocating pump 100. As illustrated, in certain embodiments, the pump 100 includes a power section 102 (e.g., power end) operatively connected with and operable to actuate a fluid section 104 (e.g., fluid end). In certain embodiments, the power section 102 and the fluid section 104 may be connected via a spacer section 106 that includes a spacer frame 107, for example. In certain embodiments, a plurality of tie-rods 105 may extend between the power and fluid sections 102, 104 through the spacer section 106 to connect the power and fluid sections 102, 104. In certain embodiments, the power section 102 may include a crankcase 108 operatively connected with a prime mover (e.g., engine, electric motor, etc.) (not shown) and a crosshead section 109 housing a plurality of crosshead assemblies 110. In certain embodiments, the crankcase 108 may be operable to transfer torque from the prime mover to the crosshead assemblies 110, which transform and transmit torque from the crankcase 108 to reciprocating linear forces causing pumping operation to be performed by the fluid section 104.

In certain embodiments, the fluid section 104 may include a pump housing 112 having a plurality of fluid-pressurizing chambers 114. One end of each fluid-pressurizing chamber 114 may contain a reciprocating, fluid-displacing member 116 slidably disposed therein and operable to displace a fluid within the corresponding fluid-pressurizing chamber 114. Although the fluid-displacing member 116 is depicted as a plunger, in other embodiments, the fluid-displacing member 116 may instead be implemented as a piston, diaphragm, or other reciprocating, fluid-displacing member.

In certain embodiments, each fluid-pressurizing chamber 114 includes or is fluidly connected with a corresponding fluid inlet cavity 118 configured to communicate fluid from a common fluid inlet 120 (e.g., inlet manifold, suction manifold) into the fluid-pressurizing chamber 114. In certain embodiments, an inlet (i.e., suction) valve 122 may selectively fluidly isolate each fluid-pressurizing chamber 114 from the fluid inlet 120 to selectively control fluid flow from the fluid inlet 120 into each fluid-pressurizing chamber 114. In certain embodiments, each inlet valve 122 may be disposed within a corresponding fluid inlet cavity 118 or otherwise between each fluid inlet cavity 118 and the corresponding fluid-pressurizing chamber 114. In addition, in certain embodiments, each inlet valve 122 may be biased toward a closed-flow position by a spring and/or other biasing means (not shown). In other embodiments, each inlet valve 122 may be actuated to an open-flow position by a predetermined differential pressure between the corresponding fluid-pressurizing chamber 114 and the fluid inlet 120.

In addition, in certain embodiments, each fluid-pressurizing chamber 114 may be fluidly connected with a common fluid outlet 124 (e.g., outlet manifold, discharge manifold). In certain embodiments, the fluid outlet 124 may be or include a fluid cavity extending through the pump housing 112 transverse to the fluid-pressurizing chambers 114. In certain embodiments, an outlet (i.e., discharge) valve 126 may selectively fluidly isolate each fluid-pressurizing chamber 114 from the fluid outlet 124 to selectively control fluid flow from each fluid-pressurizing chamber 114 into the fluid outlet 124. In certain embodiments, each outlet valve 126 may be disposed within the fluid outlet 124 or otherwise between each fluid-pressurizing chamber 114 and the fluid outlet 124. In addition, in certain embodiments, each outlet valve 126 may be biased toward a closed-flow position by a spring and/or other biasing means (not shown). In other embodiments, each outlet valve 126 may be actuated to an open-flow position by a predetermined differential pressure between the corresponding fluid-pressurizing chamber 114 and the fluid outlet 124.

During pumping operations, portions of the power section 102 may rotate in a manner that generates a reciprocating, linear motion to longitudinally oscillate, reciprocate, or otherwise move each fluid-displacing member 116 within the corresponding fluid-pressurizing chamber 114, as indicated by arrows 128. In certain embodiments, each fluid-displacing member 116 alternatingly decreases and increases pressure within each fluid-pressurizing chamber 114, thereby alternatingly receiving (e.g., drawing) fluid into and discharging (e.g., displacing) fluid out of each fluid-pressurizing chamber 114.

In certain embodiments, the crankcase 108 may include a generally circular (e.g., circular with only minor variations, such as manufacturing tolerances from being truly circular) crankcase frame 130, a crankshaft 132, and crankshaft bearings 134 supporting the crankshaft 132 in position within the crankcase frame 130. The prime mover may be operatively connected with (perhaps indirectly) and drive or otherwise rotate the crankshaft 132. In certain embodiments, the crankshaft 132 may include a plurality of crankpins 136 (e.g., offset journals) radially offset from the central axis of the crankshaft 132.

In certain embodiments, the crosshead assemblies 110 may be utilized to transform and transmit the rotational motion of the crankshaft 132 to a reciprocating, linear motion of the fluid-displacing members 116. For example, in certain embodiments, each crosshead assembly 110 may include a connecting rod 138 pivotably (e.g., rotatably) coupled with a corresponding crankpin 136 at one end and with a crosshead 140 of the crosshead assembly 110 at an opposite end. In certain embodiments, an end cap or C-clamp 139 may pivotably couple the connecting rod 138 to the crankpin 136. In certain embodiments, each connecting rod 138 may be pivotably coupled with a corresponding crosshead 140 via a wristpin joint 142. In certain embodiments, the crosshead section 109 may further include a crosshead support frame 144 (i.e., crosshead guide support frame) configured to support and guide sliding motion of each crosshead 140. In certain embodiments, during pumping operations, side walls and upper and lower friction pads of the crosshead support frame 144 may guide or otherwise permit horizontal motion of each crosshead 140 and prevent or inhibit vertical motion of each crosshead 140. In certain embodiments, the crankcase frame 130 and the crosshead support frame 144 may be integrally formed or connected. In certain embodiments, each crosshead 140 may be coupled to a respective fluid-displacing member 116 via a connecting rod 146 (e.g., pony rod). In addition, in certain embodiments, each connecting rod 146 may be coupled with a corresponding crosshead 140 via a threaded connection and with a corresponding fluid-displacing member 116 via a flexible connection. In certain embodiments, the tie-rods 105 may extend through the spacer frame 107 between the crosshead support frame 144 and the pump housing 112 to connect the power and fluid sections 102, 104.

In certain embodiments, a support base 111 may be fixedly connected to the crankcase frame 130 and the crosshead support frame 144. In certain embodiments, the support base 111 may be integrally formed or connected with the crankcase frame 130 and/or with the crosshead support frame 144. In addition, in certain embodiments, the support base 111 may extend along (e.g., underneath) and be fixedly connected (e.g., fastened) with a spacer frame 107. In addition, in certain embodiments, the support base 111 may structurally reinforce the crankcase frame 130, the crosshead support frame 144, and the spacer frame 107. In addition, in certain embodiments, the support base 111 may prevent or inhibit transfer of torque and/or linear forces and, thus, prevent or inhibit relative movement between the crankcase frame 130, the crosshead support frame 144, the spacer frame 107, and the fluid section 104. In addition, in certain embodiments, the support base 111 may be fixedly coupled to a base structure (not shown), such as a skid or mobile trailer, to fixedly connect the pump 100 to the base structure.

In certain embodiments, the pump 100 may be implemented as a triplex pump, which has three fluid-pressurizing chambers 114 and three fluid-displacing members 116. In other embodiments, the pump 100 may instead be implemented as a quintuplex pump having five fluid-pressurizing chambers 114 and five fluid-displacing members 116. In other embodiments, the pump 100 may instead be implemented as a multiplex pump including other quantities of fluid-pressurizing chambers 114 and fluid-displacing members 116.

Conventional positive displacement reciprocating pumps have separate structural components (e.g., a crankcase, a crosshead guide support, a spacer frame, a fluid end) connected in series using fully-threaded tie-rods extending through the structural components. In such conventional systems, the crankcase and the spacer frame nearest the fluid end each have a bottom support, however the crosshead guide support structure is left unsupported other than by compression due to tie-rod tension. This manner of support for a heavily loaded component (e.g., a crosshead guide support) during a forward stroke of the pumping operations is structurally inefficient and tends to have relatively high compliance and lack of rigidity, which can effectively limit the load rating of the overall pump. The embodiments described herein include a structural support system of a positive displacement reciprocating pump, such as the pump 100 illustrated in FIG. 1, configured to increase rigidity, minimize deflections and twisting, and provide proper support for critically loaded components or portions of the pump in a structurally efficient design.

Figure 2:
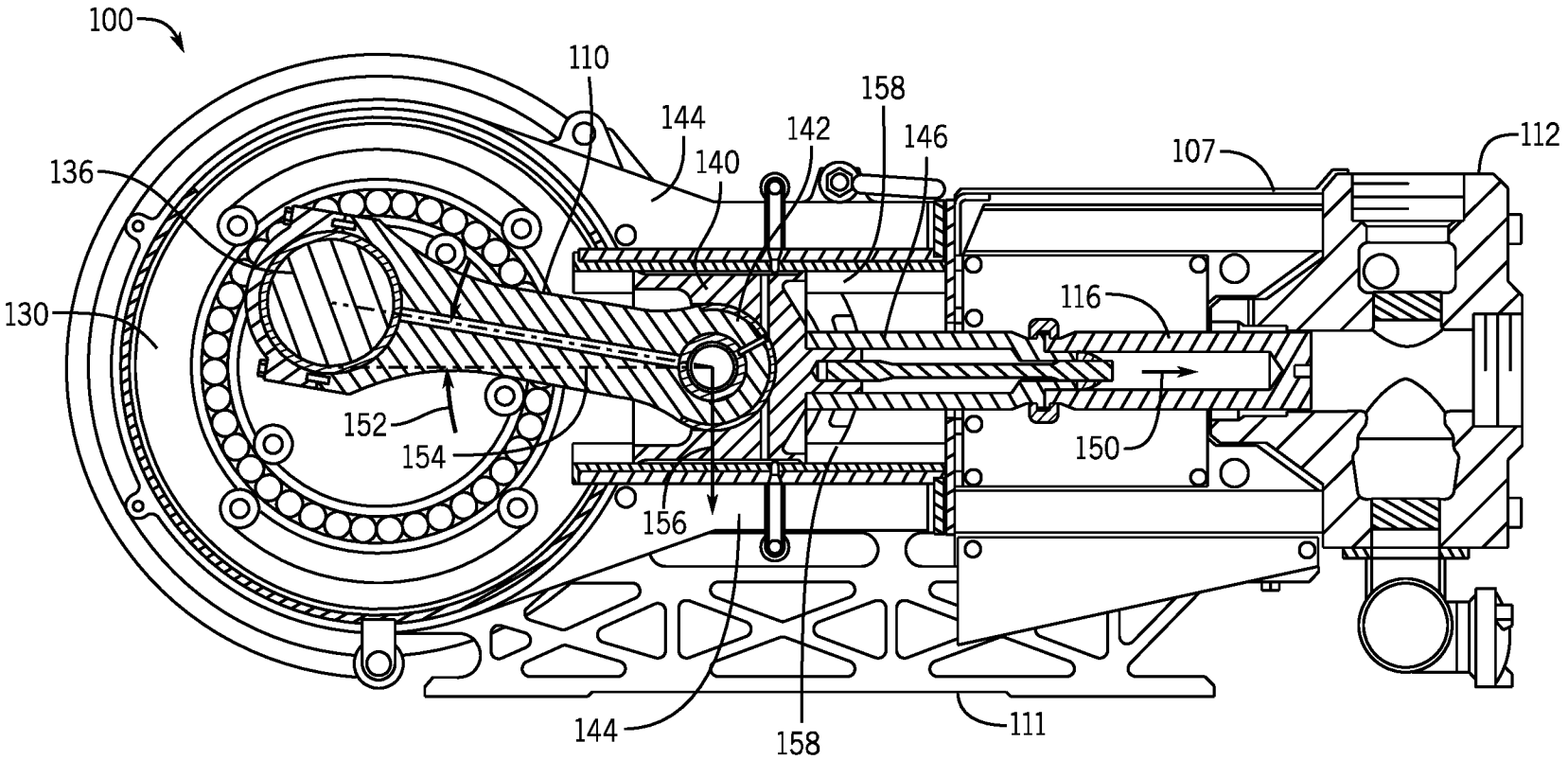
FIG. 2 is a sectional side view of the pump illustrated in FIG. 1 during a forward stroke of the pumping operations when the fluid-displacing member (e.g., a plunger) is pushed forward at high fluid pressure, in accordance with embodiments of the present disclosure.

FIG. 2 is a sectional side view of the pump 100 illustrated in FIG. 1 during a forward stroke of the pumping operations when the fluid-displacing member 116 (e.g., a plunger) is pushed forward at high fluid pressure, as indicated by arrow 150. The pump 100 is illustrated with the connecting rod 138 being pushed by the crankpin 136 while positioned at a maximum angle 152 with respect to a horizontal axis 154. At such angle 152, the connecting rod 138 can exert large downward force 156 on the crosshead 140 at the wristpin joint 142. This force 156 is transmitted downward to the support structure (e.g., the crosshead support frame 144, the pump support base 111, and so forth) for the crosshead guides 158 (e.g., crosshead guide bushings).

Figure 3:
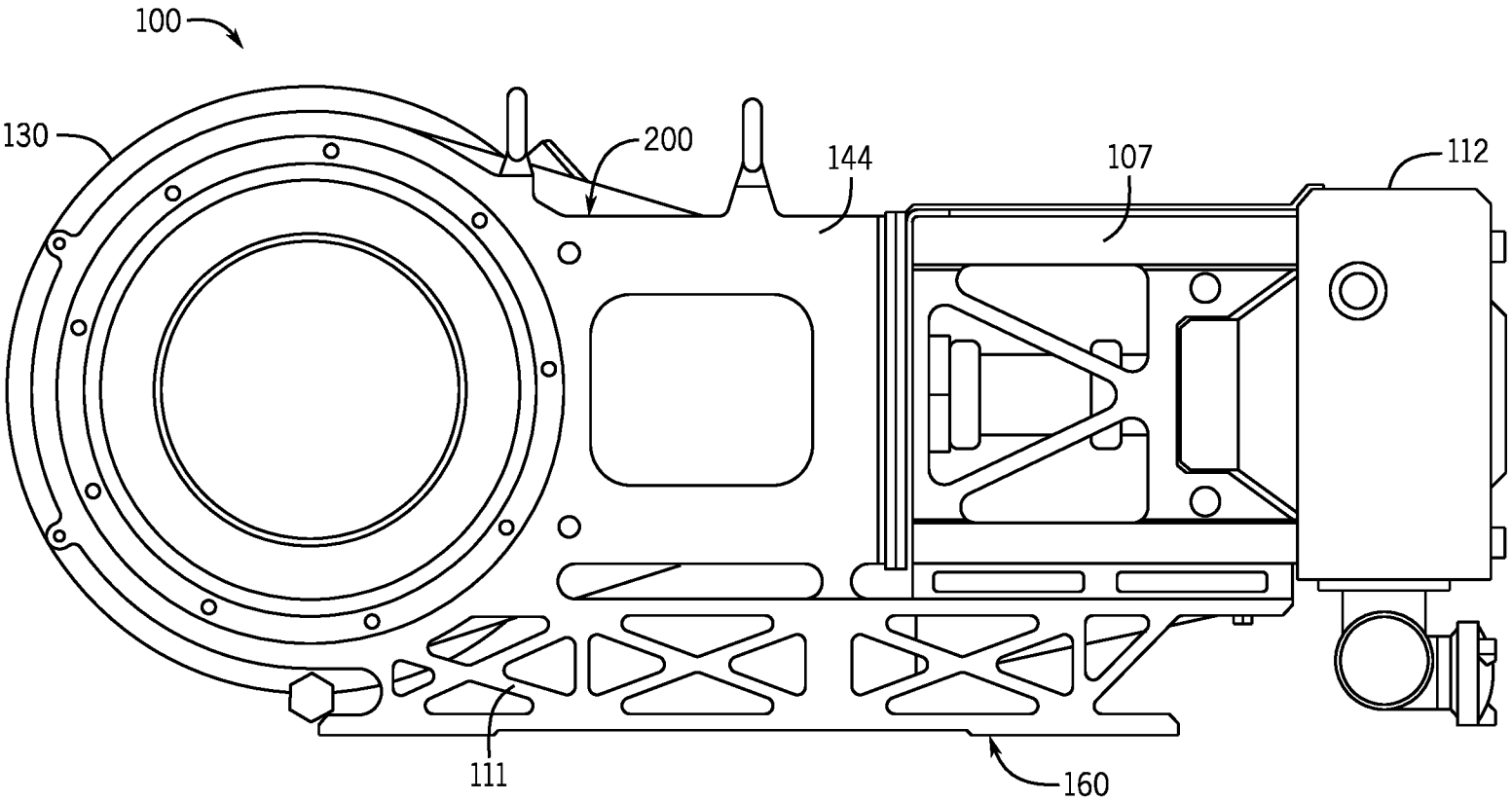
FIGS. 3 and 4 are respective side and sectional side views of the pump illustrated in FIG. 1, in accordance with embodiments of the present disclosure.
Figure 4:
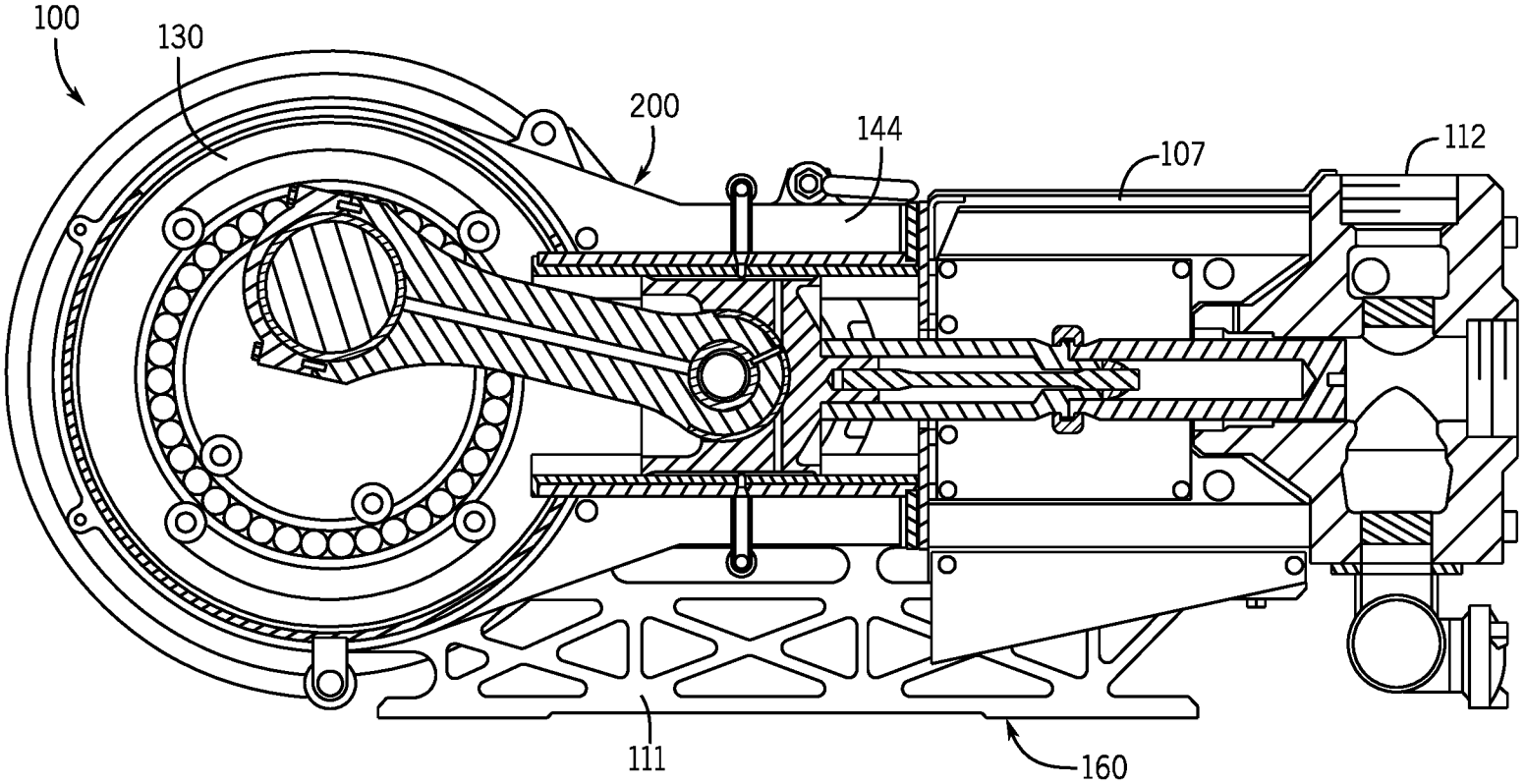

FIGS. 3 and 4 are respective side and sectional side views of the pump 100 illustrated in FIG. 1. FIGS. 3 and 4 illustrate a structurally integrated crankcase frame 130, crosshead support frame 144, and pump support base 111. In certain embodiments, the pump support base 111 may include a pedestal portion 160 extending horizontally past or beyond the crosshead support frame 144 and below the spacer frame 107. In certain embodiments, the extended pedestal portion 160 may be configured as a base for supporting the spacer frame 107, which may rest on the pedestal portion 160. In certain embodiments, the spacer frame 107 may be fastened (e.g., bolted) or otherwise connected (e.g., welded) to the pedestal portion 160 of the pump support base 111 for increased rigidity. In certain embodiments, the support base 111 may be coupled (e.g., bolted) or otherwise connected (e.g., welded) to a base (not shown), such as a skid or mobile trailer, to fixedly connect the pump 100 to the base. In certain embodiments, each of the integrated crankcase frame 130, the crosshead support frame 144, the pump support base 111, and the spacer frame 107 may be or form a portion of a pump structural support frame.

Figure 5:
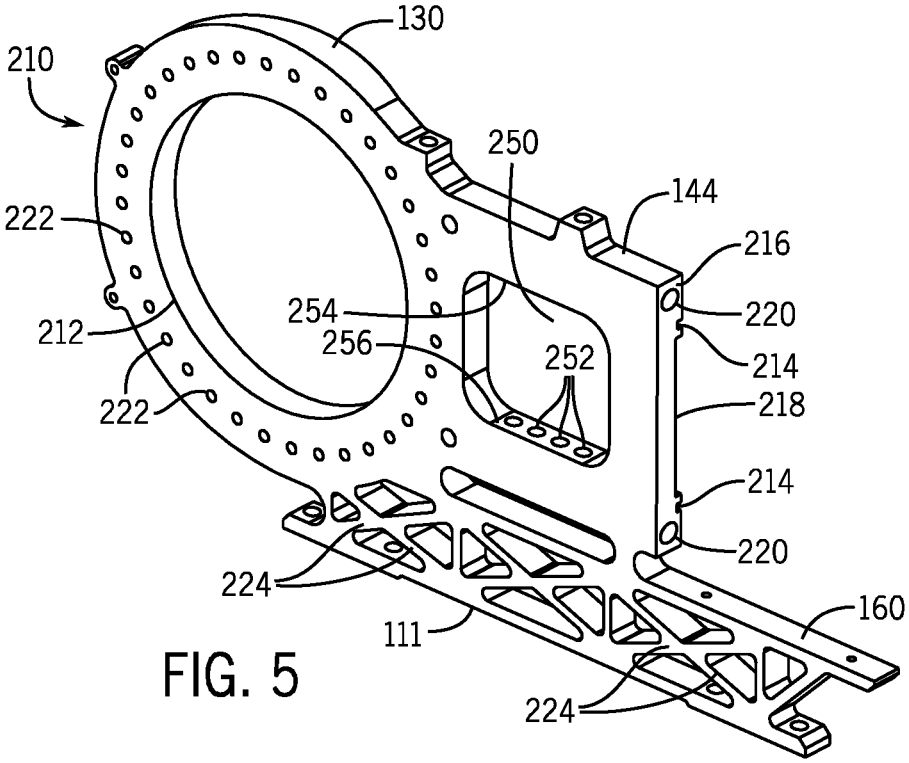
FIGS. 5 and 6 are perspective and side views, respectively, of an outboard structural member of a support frame of the pump illustrated in FIG. 1, in accordance with embodiments of the present disclosure.
Figure 6:
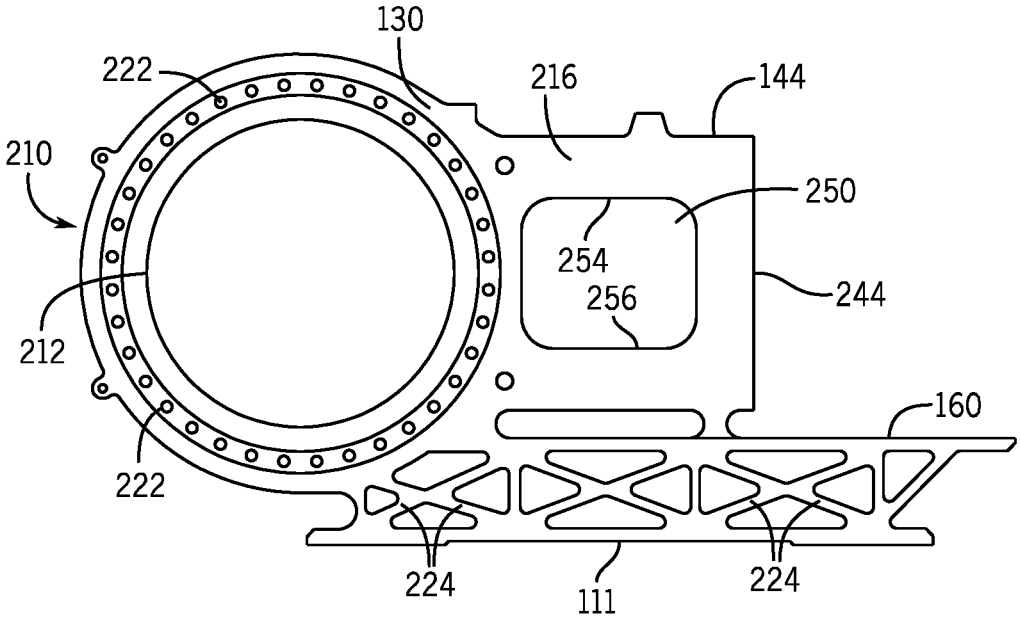

FIGS. 5 and 6 are perspective and side views, respectively, of an outboard structural member 210 of a support frame 200 of the pump 100 illustrated in FIG. 1. In certain embodiments, the support frame 200 may include two outboard structural members 210, each forming an opposing side of the support frame 200. In certain embodiments, each outboard structural member 210 may be or include a single-piece (e.g., integrally formed, discrete, unitary) member (e.g., plate) that is machined to predetermined dimensions and with predetermined features. In addition, in certain embodiments, each outboard structural member 210 may be, form, or include a corresponding portion or segment of the crankcase frame 130, the crosshead support frame 144, and the pump support base 111, including the extended pedestal portion 160. In certain embodiments, each outboard structural member 210 may further include an opening 212 for receiving the crankshaft bearing 134 and the crankshaft 132, threaded holes 222 for receiving fasteners for connecting a cover plate 213, channels 214 along a sidewall 216 for receiving and mounting crosshead guide sections 258, 260, a cavity 218 along the sidewall 216 for receiving a crosshead 140 and crosshead guides 158, and threaded holes 220 for receiving tie-rods 105 that connect the pump housing 112 to the outboard structural member 210. In certain embodiments, the channels 214 and the cavity 218 may be a mirror image of channels 234 and cavity 238 illustrated in FIGS. 7 and 8. In certain embodiments, the threaded holes 220 may extend into or through at least a portion of the outboard structural member 210 forming the crosshead support frame 144. In certain embodiments, the support base 111 may be integrally formed or connected with the crankcase frame 130 and/or the crosshead support frame 144, and may include a lattice or mesh structural members 224 (e.g., beams) configured to facilitate strength and rigidity while reducing overall weight of the support base 111.

Figure 7:
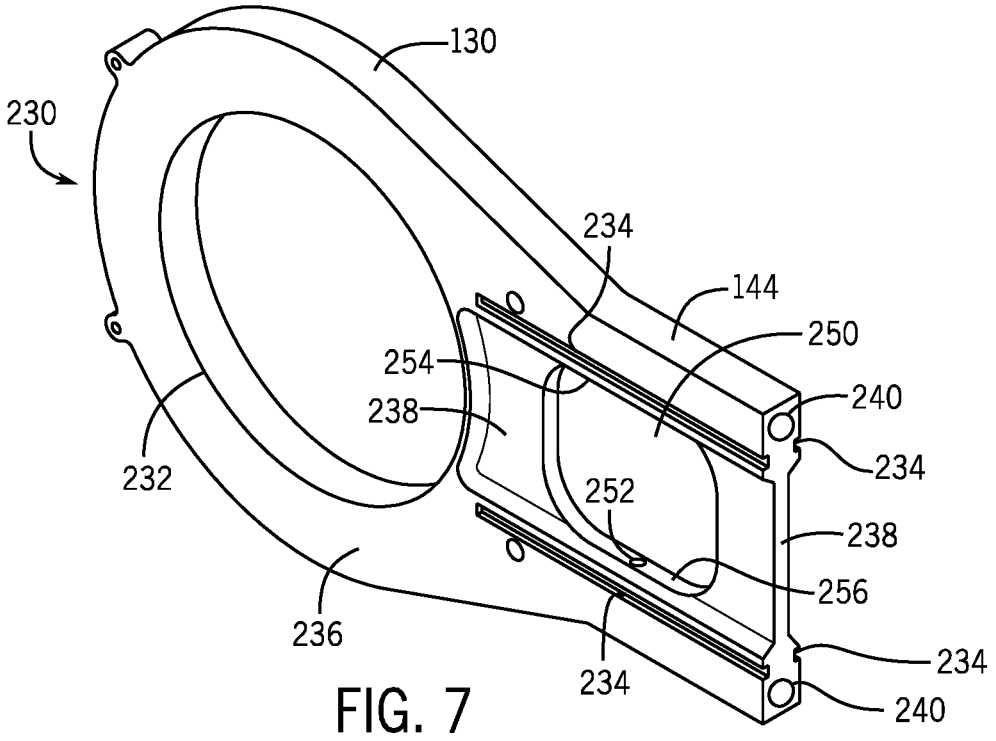
FIGS. 7 and 8 are perspective and side views, respectively, of an intermediate structural member of the support frame of the pump illustrated in FIG. 1, in accordance with embodiments of the present disclosure.
Figure 8:
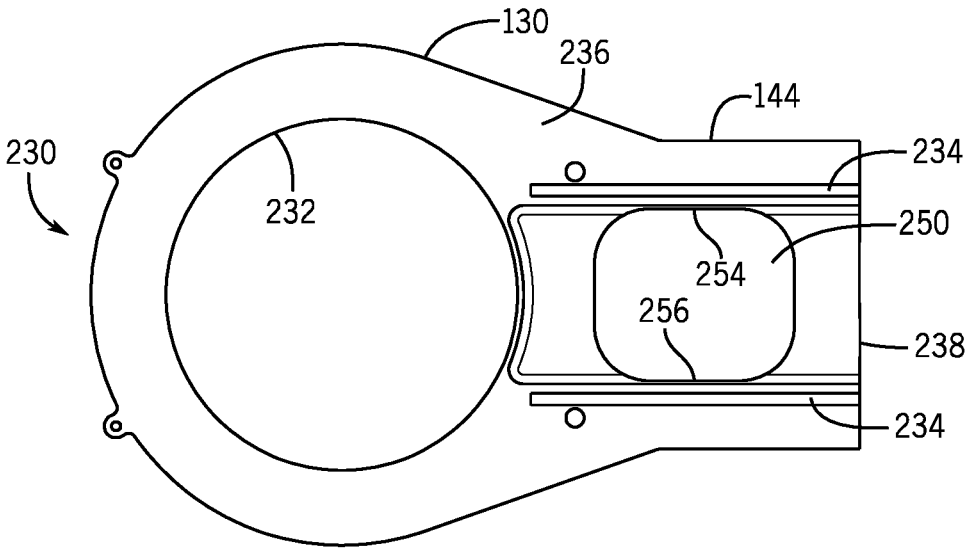

FIGS. 7 and 8 are perspective and side views, respectively, of an intermediate structural member 230 of the support frame 200 of the pump 100 illustrated in FIG. 1. In certain embodiments, the support frame 200 may include a plurality (e.g., two, four, etc.) intermediate structural members 230 located between the outboard structural members 210 illustrated in FIGS. 5 and 6. In certain embodiments, each intermediate structural member 230 may be or include a single-piece (e.g., integrally formed, discrete, unitary) member (e.g., plate) that is machined to predetermined dimensions and with predetermined features. In addition, in certain embodiments, each intermediate structural member 230 may be, form, or include a corresponding portion or segment of the crankcase frame 130 and the crosshead support frame 144. In addition, in certain embodiments, each intermediate structural member 230 may further include an opening 232 for receiving the crankshaft bearing 134 and the crankshaft 132, channels 234 along each opposing sidewall 236 for receiving and mounting crosshead guide sections 258, 260, a cavity 238 along each sidewall 236 for receiving a crosshead 140 and crosshead guides 158, and threaded holes 240 for receiving tie-rods 105 that connect the pump housing 112 to the intermediate structural member 230. In certain embodiments, the channels 234 and the cavity 238 on opposing sidewalls 236 may be mirror images of each other. In certain embodiments, the threaded holes 240 may extend into or through at least a portion of the intermediate structural member 230 forming the crosshead support frame 144.

Figure 9:
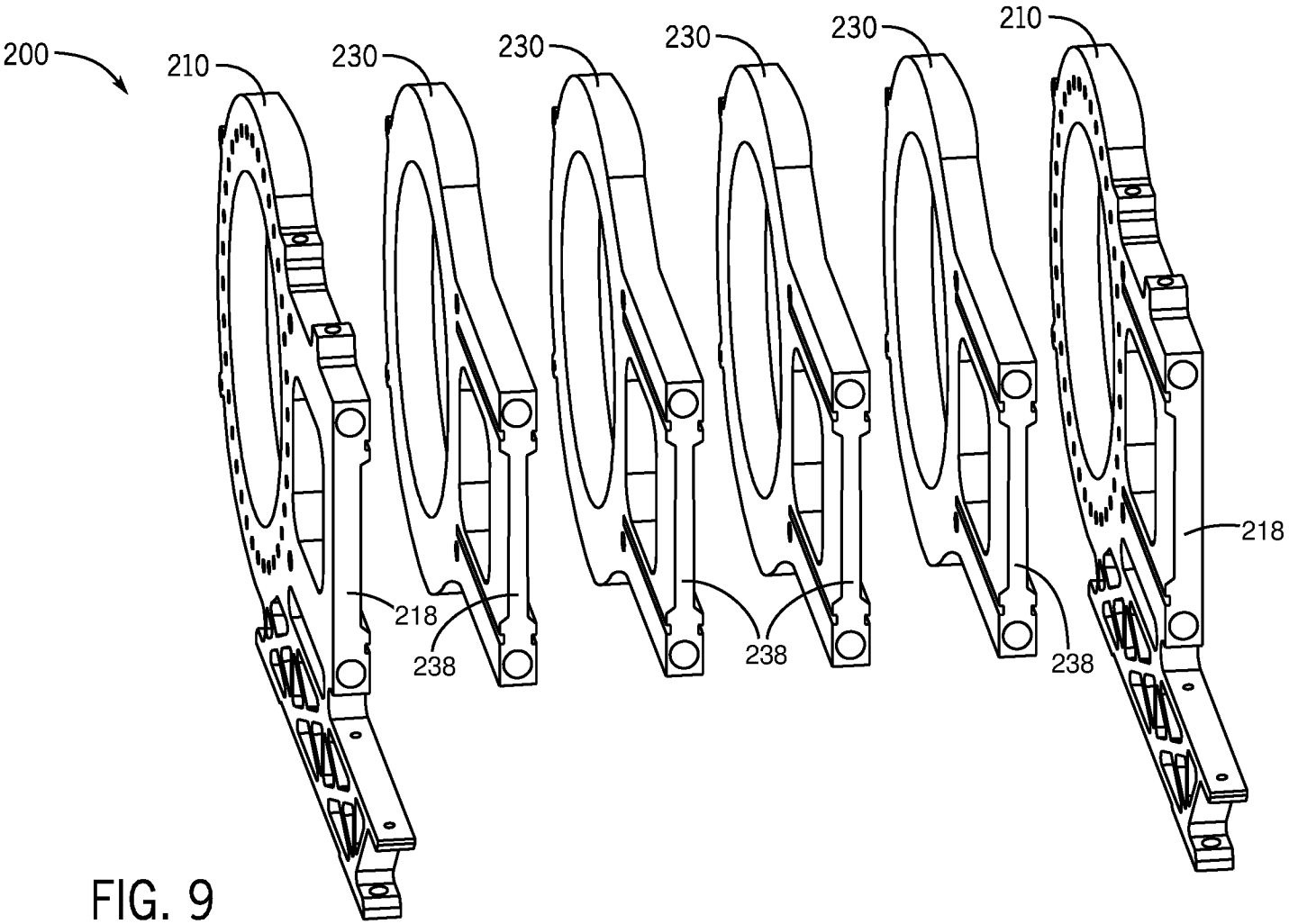
FIG. 9 is a perspective view of a portion of the support frame illustrating just the outboard and intermediate structural members illustrated in FIGS. 5-8 aligned in parallel, in accordance with embodiments of the present disclosure.

FIG. 9 is a perspective view of a portion of the support frame 200 illustrating just the outboard and intermediate structural members 210, 230 illustrated in FIGS. 5-8 aligned generally in parallel with each other (e.g., parallel with each other with only minor variance from true parallel, such as within 2% of being truly parallel, within 1% of being truly parallel, within 0.5% of being truly parallel, and so forth). In addition, in general, each of the structural members 210, 230 are aligned generally perpendicular to the central axis of the crankshaft 132 (e.g., perpendicular to the central axis of the crankshaft 132 with only minor variance from true perpendicularity, such as within 2% of being truly perpendicular to the central axis of the crankshaft 132, within 1% of being truly perpendicular to the central axis of the crankshaft 132, within 0.5% of being truly perpendicular to the central axis of the crankshaft 132, and so forth).

The support frame 200 is illustrated in FIG. 9 as being implemented as a portion of a quintuplex pump including two outboard structural members 210 and four intermediate structural members 230 collectively operable to receive five crossheads 140 and crosshead guides 158 therebetween. However, a support frame 200 within the scope of the present disclosure may instead be implemented as a portion of a triplex pump including two outboard structural members 210 and two intermediate structural members 230 collectively operable to receive three crossheads 140 and crosshead guides 158 therebetween. Indeed, other examples having different numbers of intermediate structural members 230 are also within the scope of the present disclosure.

Conventional positive displacement reciprocating pumps have crosshead guides 158 that are formed by boring a cylindrical hole in a power frame and shrinking a tubular guide into it. However, such designs limit the power end to relatively large center distances and relatively low wrist bearing areas. Other conventional positive displacement reciprocating pumps provide a set of slots between the crosshead bores, and then form cylindrical surfaces on the top and bottom into plates located in window areas. In general, the slots permit full rotation of a boring bar. In such designs, the crosshead bearing surfaces may be secured by bolts, either from the outside or the inside. Other conventional positive displacement reciprocating pumps use a crosshead guide weldment where the full round bore holes overlap without the use of connecting bars. In such designs, jacking devices may be located between the crosshead bores to push the bearing shoes outward from there edges. The embodiments described herein address the shortcomings of these conventional designs.

Figure 10:
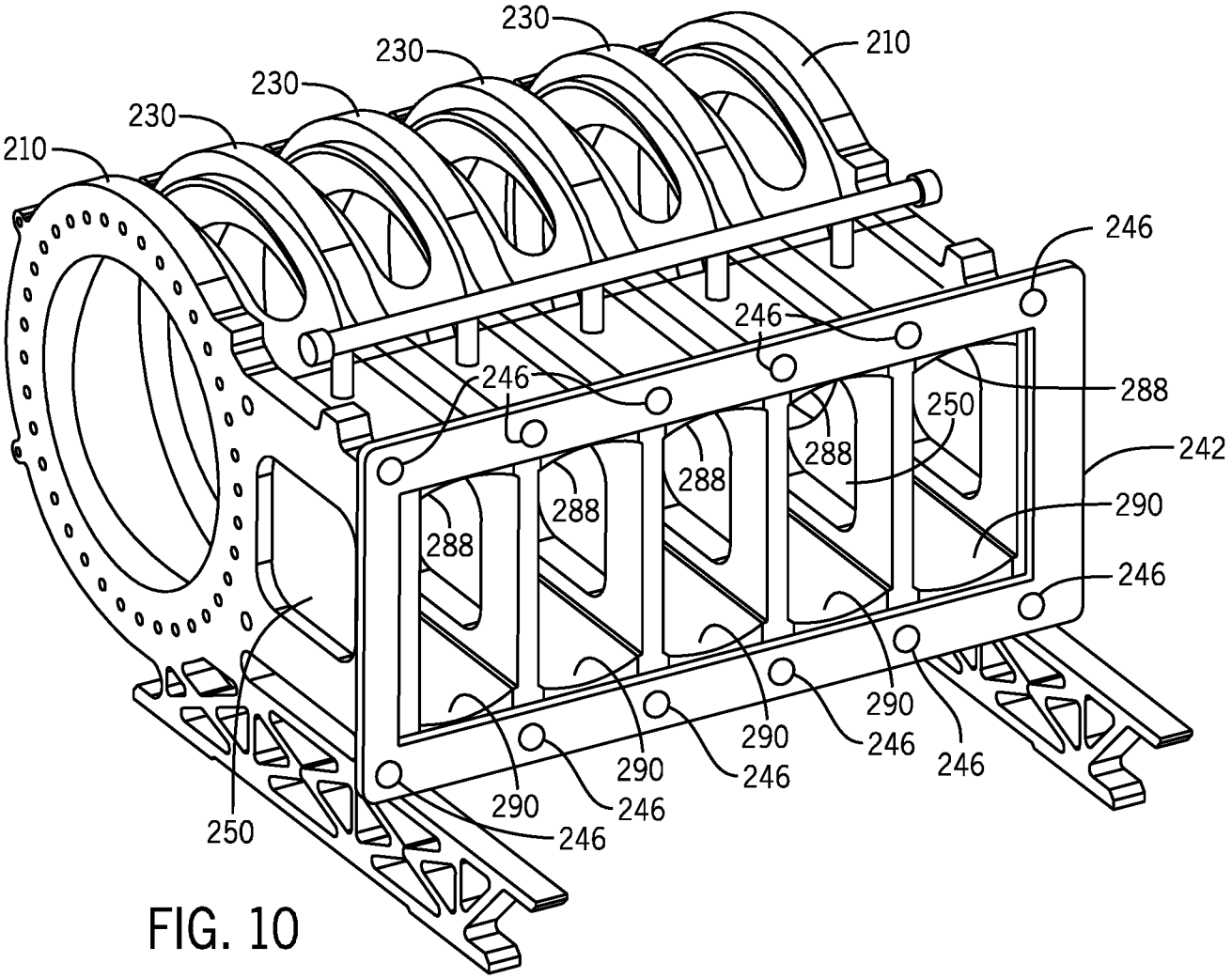
FIG. 10 is a perspective view of a portion of the support frame illustrating the outboard and intermediate structural members connected to each other by a connecting plate at axial ends of the outboard and intermediate structural members opposite axial ends of the outboard and intermediate structural members having openings for receiving a crankshaft bearing and a crankshaft, in accordance with embodiments of the present disclosure.

FIG. 10 is a perspective view of a portion of the support frame 200 illustrating the outboard and intermediate structural members 210, 230 connected to each other by a connecting plate 242 at axial ends of the outboard and intermediate structural members 210, 230 opposite axial ends of the outboard and intermediate structural members 210, 230 having the openings 212, 232 for receiving the crankshaft bearing 134 and the crankshaft 132. In certain embodiments, the connecting plate 242 may be welded to the outboard and intermediate structural members 210, 230. However, in other embodiments, other connection means may be used to connect the connecting plate 242 to the outboard and intermediate structural members 210, 230. As illustrated, in certain embodiments, the connecting plate 242 may include openings 246 that align with each of the threaded holes 220, 240 of the outboard and intermediate structural members 210, 230 to facilitate the threaded holes 220, 240 receiving tie-rods 105 that connect the pump housing 112 to the outboard structural member 210.

As described in greater detail herein, after connection of the connecting plate 242 to the outboard and intermediate structural members 210, 230, a relatively large end mill with its axes of rotation aligned generally parallel to a respective crosshead guide 158 may be introduced into a crosshead bore 248 of the respective crosshead guide 158, and used to profile precision interior surfaces of top and bottom support plates 288, 290, which are permanently joined to structural members 210, 230 between pairs of structural members 210, 230, and against which the top and bottom arcuate crosshead guide sections 258, 260 that collectively form the respective crosshead guide 158, and which pair together to form at least a portion of the respective crosshead bore 248 (see, e.g., FIGS. 11, 12, and 15), may be secured as described in greater detail herein. In certain embodiments, the relatively large end mill includes a cutting radius substantially smaller than (e.g., less than 50% of, less than 45% of, less than 40% of, less than 35% of, or even smaller than) an interior radius of the respective crosshead bore 248. In addition, in certain embodiments, the top and bottom support plates 288, 290 may be welded to pairs of structural members 210, 230, may be permanently joined to the pairs of structural members 210, 230 via adhesive bonding, or may be permanently joined to the pairs of structural members 210, 230 using other techniques.

As illustrated, in certain embodiments, each of the outboard and intermediate structural members 210, 230 may include windows 250 therethrough between the crosshead bores 248 to lighten the outboard and intermediate structural members 210, 230. In addition, in certain embodiments, as illustrated in FIGS. 5 and 7, each of the windows 250 of the outboard and intermediate structural members 210, 230 may include one or more threaded holes 252 into both top and bottom interior portions 254, 256 (e.g., interior peripheral edges) of the windows 250. As described in greater detail herein, the threaded holes 252 may be used to secure clamping segments to the structural members 210, 230 for the purpose of securing the top and bottom arcuate crosshead guide sections 258, 260 to pairs of structural members 210, 230 that are disposed on either lateral side of the crosshead guide sections 258, 260 (see, e.g., FIG. 12).

Figure 11:
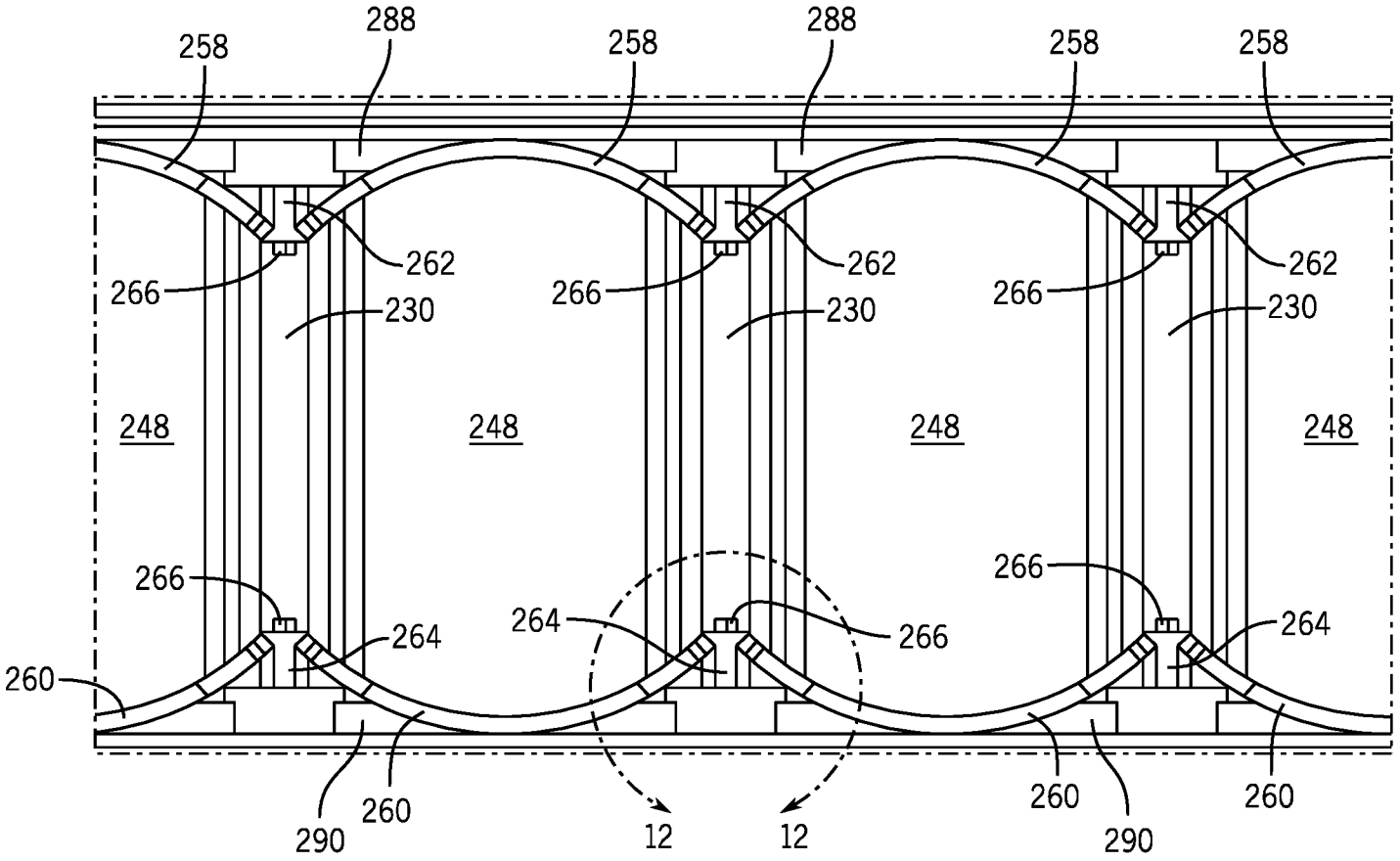
FIG. 11 is a partial sectional end view of the support frame illustrating how the structural members interact with crosshead bores, in accordance with embodiments of the present disclosure.

FIG. 11 is a partial sectional end view of the support frame 200 illustrating how the structural members 210, 230 interact with the crosshead bores 248. As illustrated in FIG. 11, the crosshead bores 248 are at least partially defined by top and bottom arcuate crosshead guide sections 258, 260 of the crosshead guides 158. As also illustrated, in certain embodiments, the generally t-shaped clamping segments 262, 264 may be installed into the windows 250 through the structural members 210, 230 adjacent the top and bottom interior portions 254, 256 of the windows 250, respectively (see, e.g., FIGS. 5-8), and secured to their respective structural members 210, 230 via bolts 266 that extend through an interior passage of the clamping segments 262, 264 and that have threads that mate with the threaded holes 252 that extend into the top and bottom interior portions 254, 256 of the windows 250. As such, due at least in part to the interaction between the clamping segments 262, 264 and the crosshead guide sections 258, 260, the crosshead guide sections 258, 260 may be secured to a respective pair of structural members 210, 230. In addition, in certain embodiments, each of the support plates 288, 290 against which the respective crosshead guide sections 258, 260 are secured may be welded to the respective pair of structural members 210, 230 such that all of the crosshead guide sections 258, 260 and structural members 210, 230 may be secured together into a unitized structure. In other embodiments, each of the support plates 288, 290 may be adhesively bonded to the respective pair of structural members 210, 230.

Figure 12:
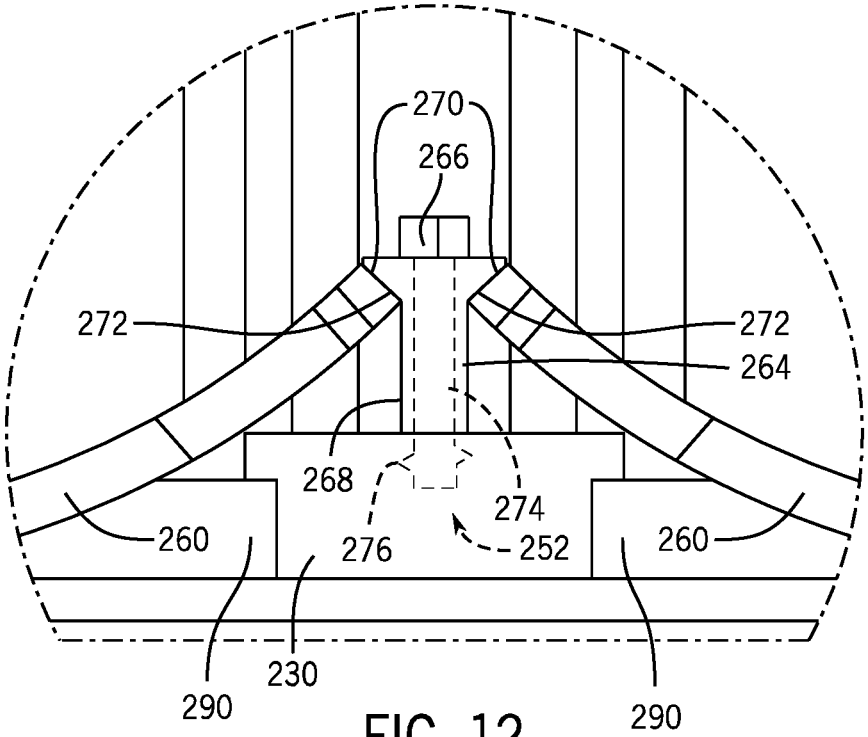
FIG. 12 is a partial sectional end view of the support frame of FIG. 11 taken along line 12-12, in accordance with embodiments of the present disclosure.

FIG. 12 is a partial sectional end view of the support frame 200 of FIG. 11 taken along line 12-12. As illustrated, in certain embodiments, the generally t-shaped clamping segments 262, 264 may have main body portions 268 and tapered surfaces 270 that extend outwardly from the main body portions 268 and that are configured to abut edges 272 of the top and bottom arcuate crosshead guide sections 258, 260 to secure the top and bottom arcuate crosshead guide sections 258, 260 relative to the structural members 210, 230. In addition, as also illustrated, in certain embodiments, the clamping segments 262, 264 may have an interior passage 274 that extends through the respective main body portion 268, and through which the bolts 266 may extend such that threads 276 of the bolts 266 may mate with threaded holes 252 that extend into the top and bottom interior portions 254, 256 of the windows 250 (see, e.g., FIGS. 5-8) to secure the clamping segments 262, 264 against the crosshead guide sections 258, 260 to secure the crosshead guide sections 258, 260 in place between a respective pair of structural members 210, 230.

Figure 13:
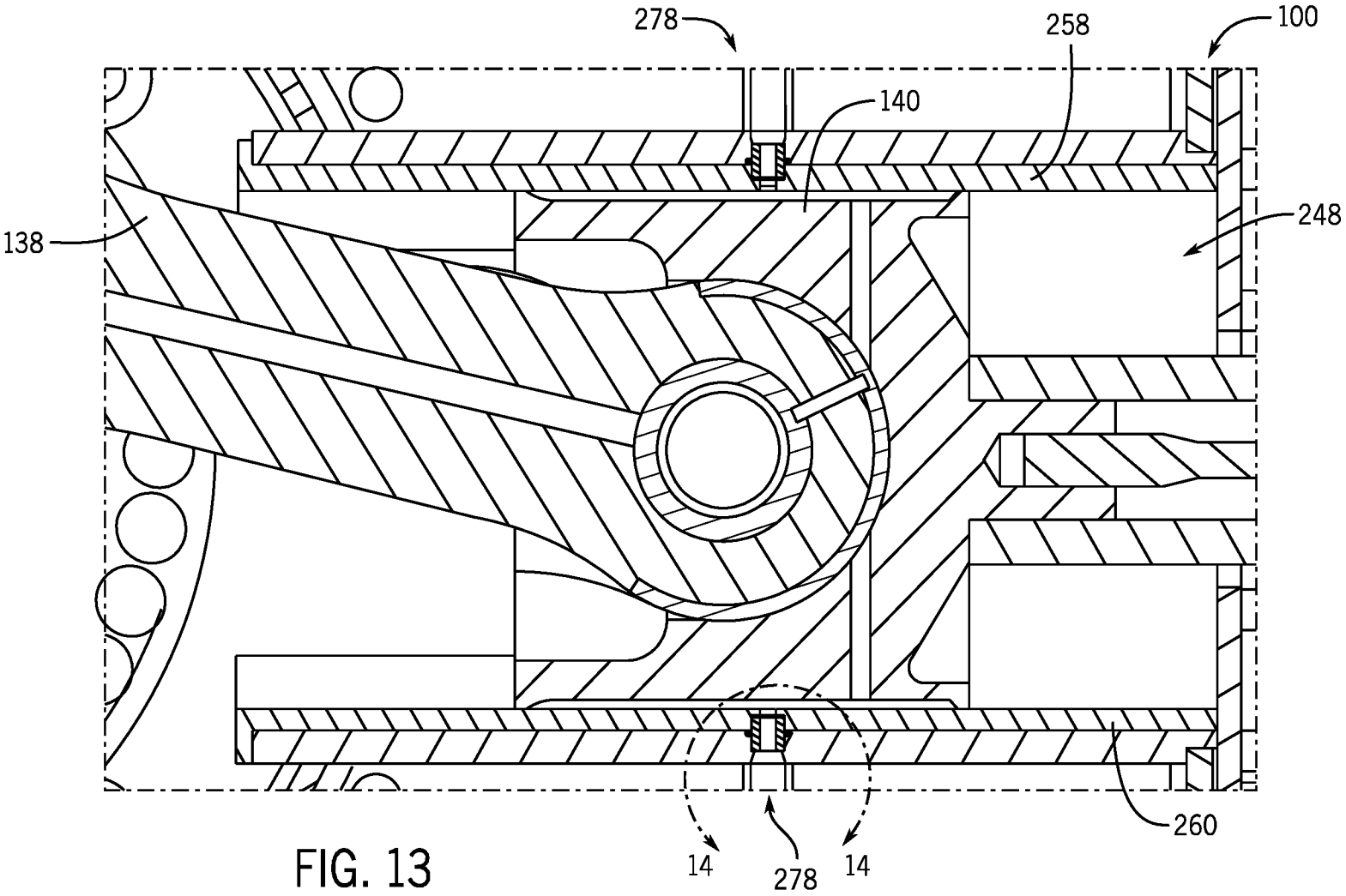
FIG. 13 is a partial sectional side view of the reciprocating pump, in accordance with embodiments of the present disclosure.
Figure 14:
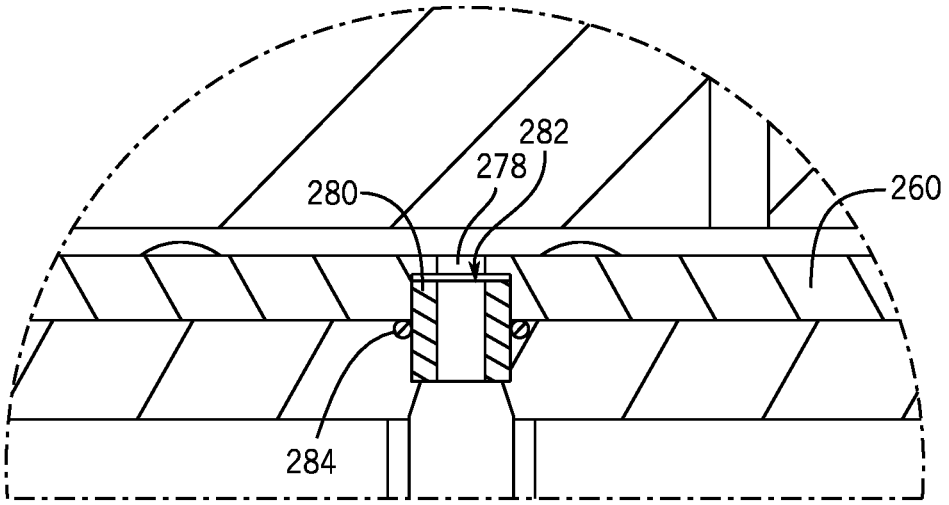
FIG. 14 is a partial sectional side view of the reciprocating pump of FIG. 13 taken along line 14-14, in accordance with embodiments of the present disclosure.

FIG. 13 is a partial sectional side view of the reciprocating pump 100. As illustrated in FIG. 13, in certain embodiments, one or both of the top and bottom arcuate crosshead guide sections 258, 260 may include a fluid port 278 extending through the respective crosshead guide section 258, 260. In general, the fluid port 278 is configured to provide fluid (e.g., lubricating oil) to the crosshead bore 248 that is at least partially defined by the pair of top and bottom arcuate crosshead guide sections 258, 260. FIG. 14 is a partial sectional side view of the reciprocating pump 100 of FIG. 13 taken along line 14-14. As illustrated in FIG. 14, in certain embodiments, each fluid port 278 may be associated with a hollow pin 280 having an interior passage 282 that aligns with the respective fluid port 278 through the respective crosshead guide section 258, 260. In addition, in certain embodiments, an o-ring seal 284 may be disposed radially around the hollow pin 280 and abutting both the hollow pin 280 and the respective crosshead guide section 258, 260.

Figure 15:
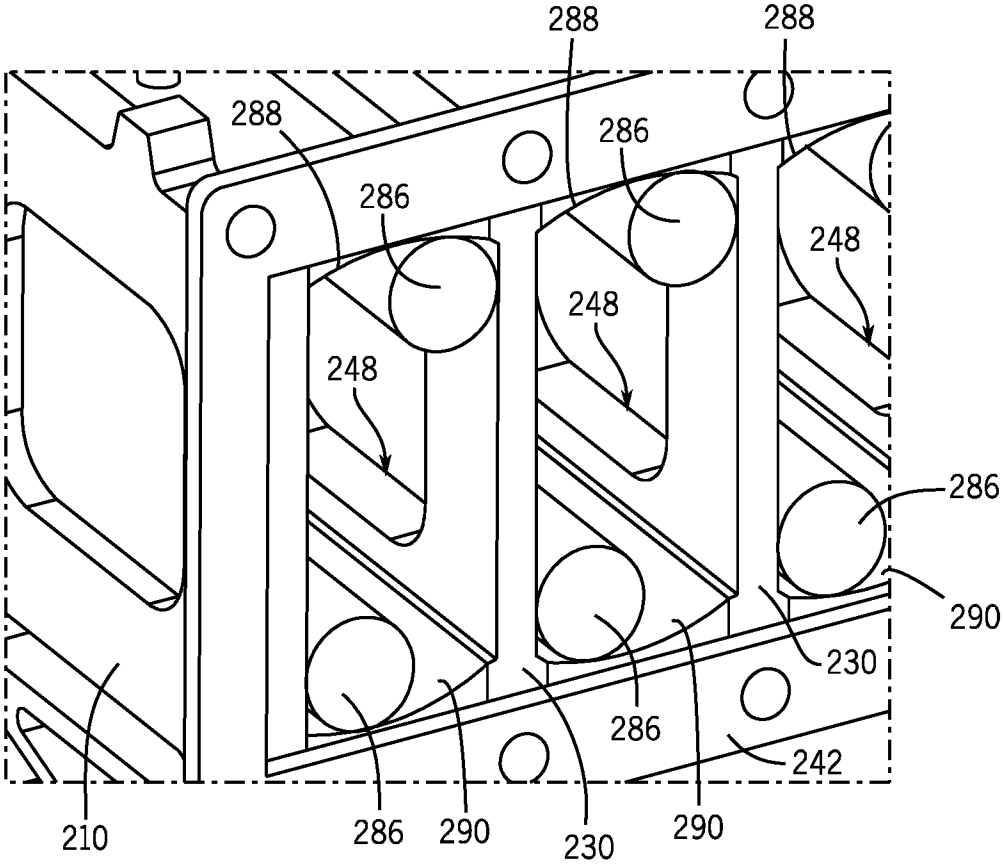
FIG. 15 is a perspective view of a portion of a portion of the reciprocating pump, illustrating end mills disposed within crosshead bores of the reciprocating pump during a profiling process, in accordance with embodiments of the present disclosure.

As described in greater detail herein, during manufacture of the reciprocating pump 100, once the structural members 210, 230 have been aligned generally parallel with each other, the top and bottom support plates 288, 290 have been permanently joined to respective pairs of the structural members 210, 230, and the connecting plate 242 has been connected to the axial ends of the structural members 210, 230, precision interior surfaces of the support plates 288, 290 may be profiled using end mills 286 introduced into the crosshead bores 248 defined by pairs of top and bottom support plates 288, 290. FIG. 15 is a perspective view of a portion of a portion of the reciprocating pump 100, illustrating the end mills 286 disposed within the crosshead bores 248 during the profiling process. As illustrated in FIG. 15, in certain embodiments, the end mills 286 include a cutting radius that is substantially smaller than (e.g., less than 50% of, less than 45% of, less than 40% of, less than 35% of, or even smaller than) an interior radius of the crosshead bores 248 defined by the respective pair of crosshead guide sections 258, 260.

However, in other embodiments, the support frame 200 may be comprised of a combination of fabricated components (e.g., machined plates, etc.) welded together with pre-cast parts. For example, in certain embodiments, the top and bottom support plates 288, 290 may instead be pre-cast out of an appropriate strength material to define crosshead bores 248 having undersized rough bore dimensions, which may then be machined to post-welded final dimensions, thereby minimizing the amount of machining needed to reach the desired bore dimensions. In addition, in certain embodiments, other features such as the fluid port 278 and associated o-ring seal chamfering may also be included beforehand in the cast parts, further saving time and cost.

Figure 16:
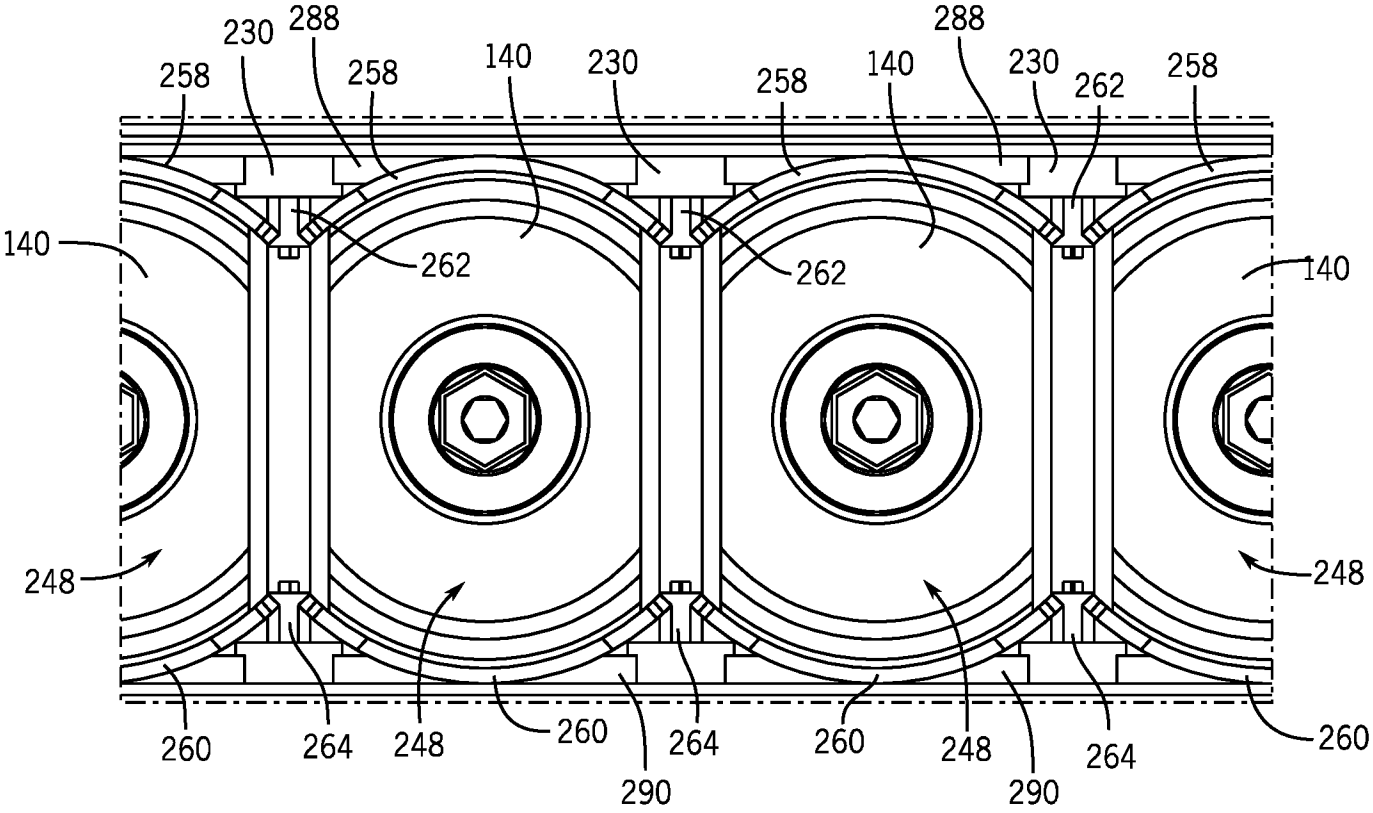
FIG. 16 is a partial sectional end view of the reciprocating pump, illustrating the crossheads disposed in respective crosshead bores at least partially defined by respective pairs of top and bottom arcuate crosshead guide sections, in accordance with embodiments of the present disclosure.

FIG. 16 is a partial sectional end view of the reciprocating pump 100, illustrating the crossheads 140 disposed in respective crosshead bores 248 at least partially defined by respective pairs of top and bottom arcuate crosshead guide sections 258, 260. The embodiments described herein allows the precision interior surfaces of the support plates 288, 290 to extend past the edges of the milled areas, with additional support provided by the clamping segments 262, 264. This also improves the side-to-side stabilization of the crossheads 140 by extending the support plates 288, 290 toward the centerline.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A reciprocating pump, comprising:

a fluid section comprising a plurality of fluid-displacing members, wherein each fluid-displacing member of the plurality of fluid-displacing members is configured to displace fluid through the reciprocating pump; and a power section comprising a plurality of crossheads, wherein each crosshead of the plurality of crossheads is coupled to a respective fluid-displacing member of the plurality of fluid-displacing members, and wherein the power section is configured to actuate the fluid section by actuating the plurality of crossheads through respective crosshead bores formed through the power section, wherein the power section comprises:

a plurality of structural members;

a plurality of pairs of support plates, each pair of support plates of the plurality of pairs of support plates permanently joined to two structural members of the plurality of structural members, wherein each support plate of each pair of support plates comprises an interior surface; and a plurality of pairs of arcuate crosshead guide sections, each arcuate crosshead guide section of the plurality of pairs of arcuate crosshead guide sections secured in place between two structural members of the plurality of structural members against a respective pair of support plates of the plurality of pairs of support plates, wherein each pair of arcuate crosshead guide sections of the plurality of pairs of arcuate crosshead guide sections comprises a top arcuate crosshead guide section and a bottom arcuate crosshead guide section configured to form a portion of a respective crosshead bore of the respective crosshead bores, and wherein each pair of arcuate crosshead guide sections is secured in place using clamping segments secured to interior peripheral edges of windows of the two structural members of the plurality of structural members by bolts extending through interior passages of the clamping segments and having threads configured to mate with threaded holes extending into the interior peripheral edges of the windows of the two structural members.

2. The reciprocating pump of claim 1, wherein the power section comprises a connecting plate disposed at an axial end of the plurality of structural members and connects the plurality of structural members to each other.

3. The reciprocating pump of claim 1, wherein the clamping segments are t-shaped and have tapered surfaces extending outwardly from a main body portion, and wherein the tapered surfaces of the clamping segments abut edges of the pair of the arcuate crosshead guide sections.

4. The reciprocating pump of claim 1, wherein the plurality of structural members comprise:

two outboard structural members, each outboard structural member of the two outboard structural members having a generally circular crankcase frame configured to support a crankshaft extending through the plurality of structural members, a crosshead support frame connected to the crankcase frame and configured to support a pair of arcuate crosshead guide sections of the plurality of pairs of arcuate crosshead guide sections, and a pedestal portion connected to the crankcase frame and to the crosshead support frame and configured to function as a base for the reciprocating pump; and a plurality of intermediate structural members disposed between the two outboard structural members, each intermediate structural member of the plurality of intermediate structural members having an additional generally circular crankcase frame configured to support the crankshaft extending through the plurality of structural members, an additional crosshead support frame connected to the crankcase frame and configured to support two pairs of arcuate crosshead guide sections of the plurality of pairs of arcuate crosshead guide sections, and no pedestal portion.

5. The reciprocating pump of claim 4, wherein the the plurality of intermediate structural members comprises two intermediate structural members.

6. The reciprocating pump of claim 4, wherein the the plurality of intermediate structural members comprises four intermediate structural members.

7. The reciprocating pump of claim 1, wherein the plurality of structural members are aligned generally parallel with each other perpendicular to a central axis of a crankshaft of the reciprocating pump, wherein the crankshaft extends through the plurality of structural members.

8. The reciprocating pump of claim 1, wherein each arcuate crosshead guide section of the plurality of pairs of arcuate crosshead guide sections comprises a fluid port extending through the arcuate crosshead guide section.

9. The reciprocating pump of claim 8, wherein the power section comprises a hollow pin secured in place adjacent to an arcuate crosshead guide section of the plurality of pairs of arcuate crosshead guide sections, wherein the hollow pin comprises an interior passage configured to align with the fluid port of the arcuate crosshead guide section.

10. The reciprocating pump of claim 1, comprising a spacer section disposed between the fluid section and the power section.

11. A method, comprising:

aligning a plurality of structural members generally parallel with each other;

permanently joining a plurality of pairs of support plates to respective pairs of the plurality of structural members;

securing a plurality of pairs of arcuate crosshead guide sections to respective pairs of the plurality of structural members against a respective pair of support plates of the plurality of pairs of support plates, wherein each pair of arcuate crosshead guide sections of the plurality of pairs of arcuate crosshead guide sections at least partially defines a respective crosshead bore, and wherein each pair of arcuate crosshead guide sections is secured in place using clamping segments secured to interior peripheral edges of windows of a respective pair of the plurality of structural members by bolts extending through interior passages of the clamping segments and having threads configured to mate with threaded holes extending into the interior peripheral edges of the windows of the respective pair of the plurality of structural members;

connecting a connecting plate to axial ends of the plurality of structural members; and profiling interior surfaces of each pair of arcuate crosshead guide sections of the plurality of pairs of arcuate crosshead guide sections with an end mill introduced into the respective crosshead bore defined by the pair of arcuate crosshead guide sections, wherein the end mill comprises a cutting radius substantially smaller than an interior radius of the respective crosshead bore defined by the pair of arcuate crosshead guide sections.

12. The method of claim 11, wherein aligning the plurality of structural members generally parallel with each other comprises aligning the plurality of structural members generally perpendicular to a central axis of a crankshaft of the reciprocating pump, and wherein the crankshaft extends through the plurality of structural members.

13. The method of claim 11, wherein the clamping segments are t-shaped and have tapered surfaces extending outwardly from a main body portion, and wherein the tapered surfaces of the clamping segments abut edges of the pair of the arcuate crosshead guide sections.

14. The method of claim 11, comprising welding the connecting plate to the axial ends of the plurality of structural members.

15. The method of claim 11, comprising connecting the plurality of structural members to a pump housing using tie-rods that extend through respective openings in the connecting plate and mate with threaded holes of the plurality of structural members.

16. A reciprocating pump, comprising:

a fluid section comprising a plurality of fluid-displacing members, wherein each fluid-displacing member of the plurality of fluid-displacing members is configured to displace fluid through the reciprocating pump, and wherein each fluid-displacing member of the plurality of fluid-displacing members is coupled to a respective connecting rod; and a power section comprising a plurality of crossheads, wherein each crosshead of the plurality of crossheads is coupled to a respective connecting rod, and wherein the power section is configured to actuate the fluid section by actuating the plurality of crossheads through respective crosshead bores formed through the power section, wherein the power section comprises:

a plurality of structural members, wherein the plurality of structural members are aligned generally parallel with each other perpendicular to a central axis of a crankshaft of the reciprocating pump, and wherein the crankshaft extends through the plurality of structural members;

a plurality of pairs of support plates, each pair of support plates of the plurality of pairs of support plates permanently joined to two structural members of the plurality of structural members, wherein each support plate of the plurality of pairs of support plates comprises an interior surface;

a plurality of pairs of arcuate crosshead guide sections secured to respective pairs of the plurality of structural members against a respective pair of support plates of the plurality of pairs of support plates by t-shaped clamping segments having tapered surfaces extending outwardly from a main body portion, wherein the tapered surfaces of the clamping segments abut edges of the arcuate crosshead guide sections, and wherein each pair of arcuate crosshead guide sections of the plurality of pairs of arcuate crosshead guide sections comprises a top arcuate crosshead guide section and a bottom arcuate crosshead guide section configured to form a portion of a respective crosshead bore; and a connecting plate disposed at an axial end of the plurality of structural members that connects the plurality of structural members to each other.

17. The reciprocating pump of claim 16, wherein the plurality of structural members comprise:

two outboard structural members, each outboard structural member of the two outboard structural members having a generally circular crankcase frame configured to support a crankshaft extending through the plurality of structural members, a crosshead support frame connected to the crankcase frame and configured to support a pair of arcuate crosshead guide sections of the plurality of pairs of arcuate crosshead guide sections, and a pedestal portion connected to the crankcase frame and to the crosshead support frame and configured to function as a base for the reciprocating pump; and a plurality of intermediate structural members disposed between the two outboard structural members, each intermediate structural member of the plurality of intermediate structural members having an additional generally circular crankcase frame configured to support the crankshaft extending through the plurality of structural members, an additional crosshead support frame connected to the crankcase frame and configured to support two pairs of arcuate crosshead guide sections of the plurality of pairs of arcuate crosshead guide sections, and no pedestal portion.

18. The reciprocating pump of claim 16, wherein each arcuate crosshead guide section of the plurality of pairs of arcuate crosshead guide sections comprises a fluid port extending through the arcuate crosshead guide section.

* * * * *